US006769932B1

(12) United States Patent
Daoud

(10) Patent No.: US 6,769,932 B1
(45) Date of Patent: Aug. 3, 2004

(54) BRACKET FOR WAVE SOLDER APPLICATION

(75) Inventor: Bassel H. Daoud, Parsippany, NJ (US)

(73) Assignee: CommScope Solutions Properties, LLC, Sparks, NV (US)

( * ) Notice: Subject to any disclaimer, the term of this patent is extended or adjusted under 35 U.S.C. 154(b) by 428 days.

(21) Appl. No.: 09/405,872

(22) Filed: Sep. 24, 1999

(51) Int. Cl.[7] ..... H01R 13/60
(52) U.S. Cl. ..... 439/532; 439/458; 439/493
(58) Field of Search ..... 439/404, 709, 439/493, 76.1, 458, 570, 532, 97 R, 55

(56) References Cited

U.S. PATENT DOCUMENTS 4,150,867 A * 4/1979 Knickerbocker ..... 439/97 P
4,580,864 A * 4/1986 Knickerbocker ..... 439/98
4,767,338 A * 8/1988 Dennis ..... 439/55
4,773,867 A * 9/1988 Keller ..... 439/49
5,336,109 A * 8/1994 Hillbish ..... 439/540
5,498,174 A * 3/1996 Speer ..... 439/567
6,033,259 A * 3/2000 Daoud ..... 439/573
6,068,508 A * 5/2000 Daoud ..... 439/490
6,102,729 A * 8/2000 Daoud ..... 439/402

* cited by examiner

*Primary Examiner*—P. Austin Bradley
*Assistant Examiner*—James R. Harvey
(74) *Attorney, Agent, or Firm*—Myers Bigel Sibley & Sajovec

(57) ABSTRACT

The present invention is directed to a bracket for holding a printed circuit board in relation to a connector for wave solder application comprising a mounting element for attaching the bracket to the connector, a shelf for supporting at least a portion of the printed circuit board at a predetermined height above the connector and a latch for retaining the printed circuit board on the shelf.

19 Claims, 4 Drawing Sheets

BRACKET FOR WAVE SOLDER APPLICATION

FIELD OF THE INVENTION

The present invention relates to a bracket for holding a printed circuit board on a connector for wave solder application.

BACKGROUND OF THE INVENTION

Connectors, such as type 66 connectors, are insulation displacement connectors used where wire enters buildings as a termination for telephone cables. The connectors designed for use on wave solder machines are normally designed with short pins (approximately 0.125"). Connectors designed for use through an automatic wire wrap machine are normally designed with long pins (approximately 0.375") for use with a single wire wrap.

However, manufacturing two different types of connectors with different size pins is costly. Not only are costs increased in having to change manufacture procedures for the different size pins but also in the inventory, stock, ordering, etc., for different component parts as well as different finished products.

Additionally, applications for using a printed circuit board in conjunction with wire wrap application are possible but have not been utilized. This is primarily due to difficulty in soldering the printed circuit board to the wire wrap pins of the connector. In this regard, the use of a printed circuit board may be an alternative in applications where two or more wire wraps cannot be used on a pin.

SUMMARY OF THE INVENTION

The present invention is directed to a bracket for holding a printed circuit board in relation to a connector for wave solder application comprising a mounting element for attaching the bracket to the connector, a shelf for supporting at least a portion of the printed circuit board at a predetermined height above the connector and a latch for retaining the printed circuit board on the shelf.

The mounting element is preferably a hole through which a screw passes to an existing mounting screwhole on the connector.

The latch is preferably associated with a flexible arm to allow the latch to snap over the printed circuit board when pushed into place without additional mechanical elements or manipulation.

The shelf is provided at a predetermined height from the connector so that a plurality of brackets can be attached to the connector to hold the printed circuit board uniformly above the connector. The uniform retention of the board above the connector provides a basis for a quality wave solder application.

The material of the bracket is preferably a high temperature material to withstand the heat of the wave solder application.

The bracket also preferably includes additional mounting means, such as screwholes and screws, to compensate for the mounting holes used in the attachment of the bracket to the connector.

BRIEF DESCRIPTION OF THE DRAWINGS

The following drawings, in which like reference characters refer to like parts, are presented merely to illustrate the preferred embodiment of the invention without limiting the invention in any manner whatsoever.

DETAILED DESCRIPTION OF THE PREFERRED EMBODIMENT

Figure 1A:
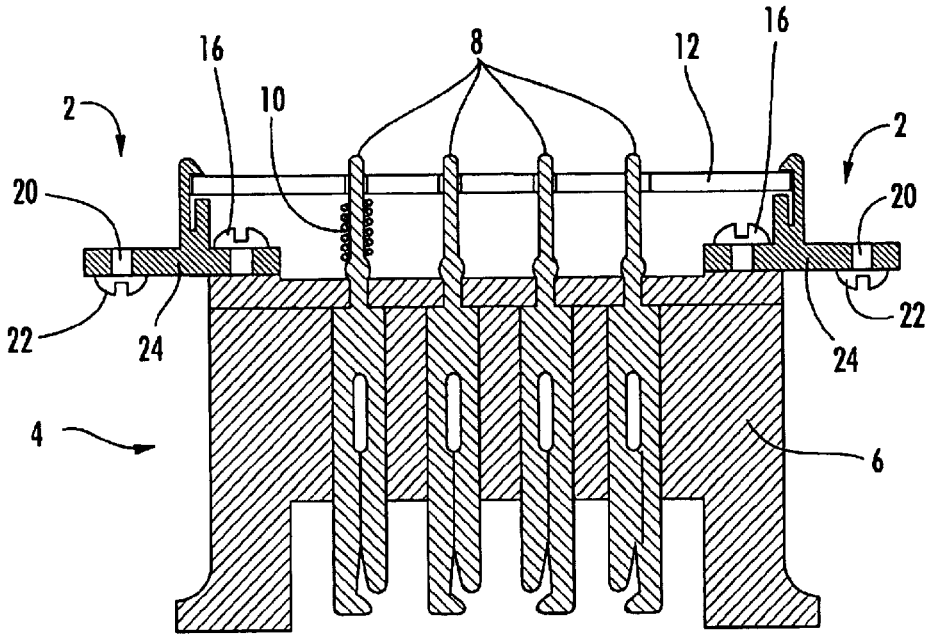
FIG. 1A is a cross-sectional elevation of a connector having the preferred bracket of the present invention mounted thereon, holding a printed circuit board.
Figure 1B:
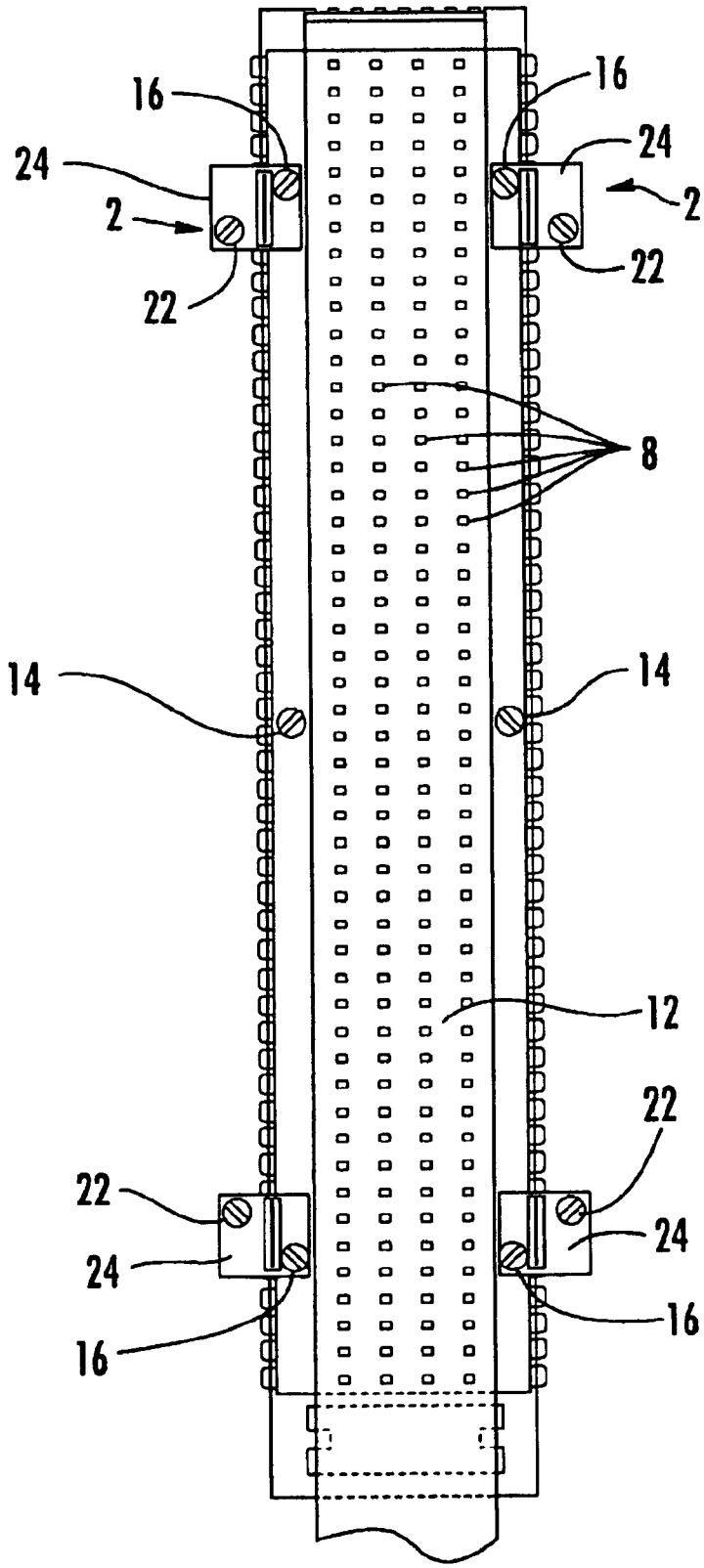
FIG. 1B is a plan view of a connector having the preferred bracket of the present invention mounted thereon, holding a printed circuit board.

The bracket 2 of the present invention, as shown in FIGS. 1A and 1B, is attached to a standard type 66 connector 4 for wave solder application. The connector 4 generally comprises a block 6 with a plurality of wire wrap pins 8 at the top thereof and mounting screws 14 as a means to mount the connector 4. The pins 8 can be wire wrapped 10 for electrical connections and/or can have a printed circuit board 12 mounted on the pins 8 through use of the present invention.

Figure 2A:
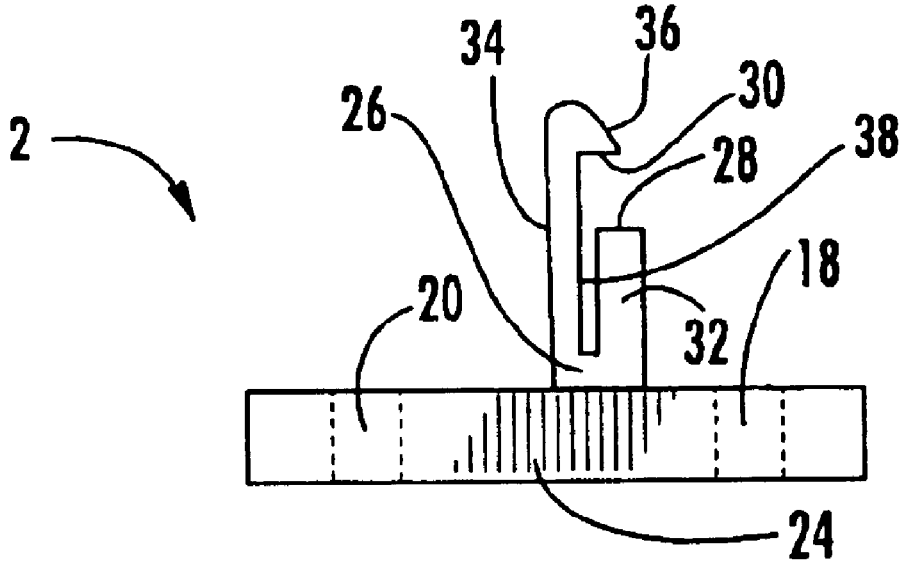
FIG. 2A is a side elevation of the preferred bracket of the present invention.
Figure 2B:
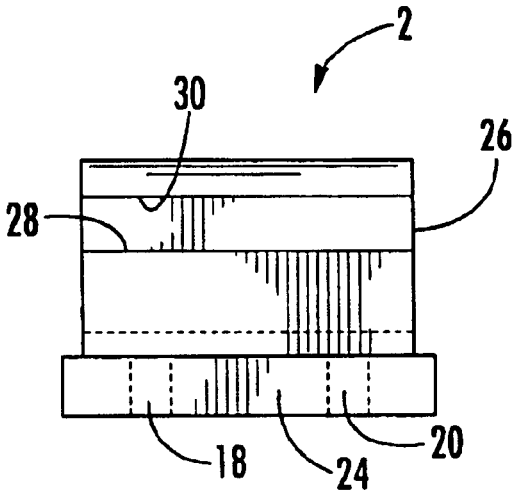
FIG. 2B is a front elevation of the preferred bracket of the present invention.
Figure 2C:
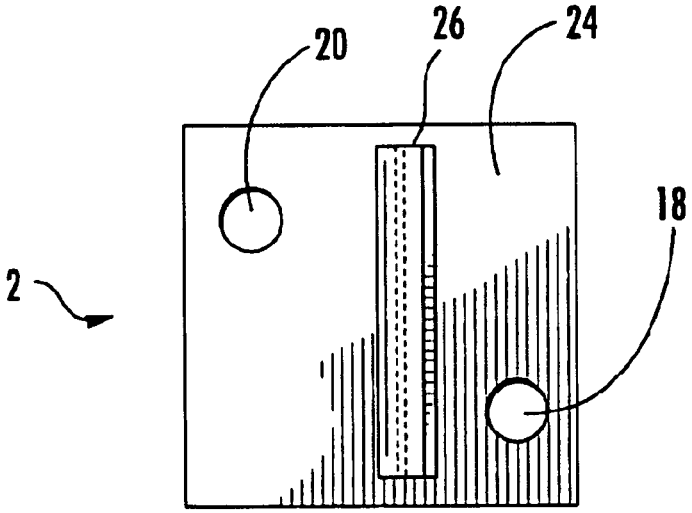
FIG. 2C is a plan view of the preferred bracket of the present invention.

The bracket 2 of the present invention, as best seen in FIGS. 2A–2C, is preferably mounted to the connector 4 through the use of existing connector mounting screwholes on the connector 4 to which connector mounting screws 14 are fastened. Bracket mounting screws 16, which pass through an opening 18 in the base 24 of the bracket 2, engage the existing connector mounting screwholes in the connector 4.

The most preferred bracket 2 also has alternative connector mounting means such as a screwhole 20 in the base 24 of the bracket 2 having a screw 22 therein for mounting the connector 4 when the bracket 2 is attached to the connector 4.

Of course, the particular means for mounting the bracket 2 to the connector is not essential to the invention, the above method merely being most preferred. Any known or later developed method or means is contemplated as long as a solid attachment is made. In this respect, removable attachment is preferred but not required for practicing the present invention. Suitable attachment means may include snaps, clips, rivets, dogs, pins, adhesives, epoxies, cements, solder, detents, or any such means.

Use of the existing mounting screwhole on the connector 4 is most preferred, however, because it is a consistent attachment point which limits human error to provide proper placement of the bracket 2 on the connector 4. This is especially true wherein the distance from the existing sheet metal mounting screwhole on known connectors 4 to the first pin 8 is a constant value in all type 66 connectors.

Extending upwardly from the base 24 of the preferred bracket 2 is a retention member 26 for securing the printed circuit board 12 to the connector 4. The retention member 26 preferably comprises a shelf 28 for providing support to the bottom of the printed circuit board 12 at a consistent height above the connector 4, and a latch 30 for contacting the top of the board 12 and holding the board 12 securely on the shelf 28.

Although the shelf 28 is preferably on a substantially rigid post 32, the latch 30 is preferably at the end of a substantially flexible arm 34. Additionally, the top surface of latch 30 is preferably a cammed member 36 so that the printed circuit board 12 can be snapped into place without additional tools. In this regard, the board 12 is pushed down on the cammed member 36, thereby moving the flexible arm 34 outwardly until the board 12 passes the latch 30 and the flexible arm 34 snaps back for the latch 30 to secure the board 12.

To facilitate the substantially flexible characteristic of the arm 34 on which the latch 30 is located, it is preferred that the retention member 26 includes a slot 38 between the flexible arm 34 and the rigid post 32. Additionally, the thickness of the flexible arm 34 is preferably less than the thickness of the rigid post 32 to further facilitate flexibility of the arm 34, so that the board 12 can be snapped into place.

It is also preferred that the printed circuit board 12 designed for use with the present bracket 2 have notches in the area of the brackets 2, corresponding generally to the width of the flexible arm 34, to limit lateral movement of the board 12 mounted on the brackets 2.

The preferred bracket 2 is made of unitary construction of a material designed to withstand the high temperatures of wave solder applications. Although high melting point polymers can be injection molded for use in the present invention, brackets 2 made of a unitary metal structure is suitable, with aluminum being most preferred.

In its most preferred embodiment, the shelf 28 on the rigid post 32 extends about 0.25" off of the connector 4 having 0.375" pins thereon. The latch 30 is located about 0.07" above the shelf 28, corresponding to the thickness of a printed circuit board 12. The flexible arm 34 and rigid post 32 in the most preferred embodiment are about 0.5" wide for securely engaging the printed circuit board 12 in a level configuration above the connector 4. To allow for flexibility of the arm 34, the flexible arm 34 is about 0.04" thick and the flexible arm 34 extends upwardly about 0.3" from the bottom of the slot 38. The rigid post 32 is preferably about 0.05" thick.

In practice it is preferred that four (4) brackets 2 are used, one generally corresponding to each corner of the board, to provide sufficient support and level mounting of the printed circuit board 12 for wave solder application. The notches in the preferred printed circuit board conform generally to the width of the flexible arm 34, 0.5" in the most preferred embodiment described immediately above.

Variations and modifications to the invention described herein will make themselves apparent to a person skilled in the art reviewing this disclosure. All such variations and modifications are intended to fall within the spirit and scope of the present invention, limited only by the following claims.

I claim:

1. A bracket for holding a printed circuit board in relation to a connector for wave solder application, the connector having a block with one or more mounting screwholes therein and a plurality of wire wrap pins extending upwardly therefrom, comprising a mounting element adapted to engage at least one mounting screwhole on the connector for attaching the bracket to the connector, a shelf for supporting at least a portion of a bottom of the printed circuit board at a predetermined height above the connector and a latch for retaining the printed circuit board on the shelf.

2. The bracket of claim 1 wherein the latch is associated with a flexible arm.

3. The bracket of claim 1 wherein the shelf comprises a top surface of a rigid post.

4. The bracket of claim 2 wherein the flexible arm extends upwardly from the base.

5. The bracket of claim 4 further comprising a rigid post extending upwardly from the base, the shelf comprising a top surface of the rigid post.

6. The bracket of claim 2 further comprising a cammed surface above the latch for moving the flexible arm when the printed circuit board is pushed downwardly onto the cammed surface.

7. The bracket of claim 1 wherein the mounting means comprises a hole in the base through which a screw extends to engage a mounting screwhole on the block of the connector.

8. The bracket of claim 1 wherein the base further comprises an alternative mounting screwhole for engagement by a screw for mounting the connector with the bracket attached thereto.

9. The bracket of claim 1 wherein the bracket is formed as a one piece integral member.

10. The bracket of claim 9 wherein the bracket is formed of aluminum.

11. A connector having a printed circuit board mounted thereon for wave solder application, the connector having a block with one or more mounting screwholes therein and a plurality of wire wrap pins extending upwardly therefrom, the improvement comprising a plurality of brackets for holding a printed circuit board in relation to the connector, each bracket comprising a mounting element for attaching the bracket to the connector, a shelf for supporting at least a portion of a bottom of the printed circuit board at a predetermined height above the connector and a latch for retaining the printed circuit board on the shelf, said printed circuit board comprising a plurality of notches corresponding to the location and dimensions of the brackets for restricting lateral movement of the printed circuit board.

12. A bracket for holding a printed circuit board in relation to a connector for wave solder application, said connector having a block with a plurality of wire wrap pins at the top thereof and a plurality of mounting screwholes on the block which accept screws to mount the connector, the bracket consisting essentially of a mounting element adapted to engage at least one mounting screwhole on the connector for attaching the bracket to the connector, a shelf for supporting at least a portion of a bottom of the printed circuit board at a predetermined height above the connector, a latch for retaining the printed circuit board on the shelf and, optionally, an additional hole in said base for mounting the connector having the bracket thereon.

13. The bracket of claim 12 wherein the latch is associated with a flexible arm.

14. The bracket of claim 12 wherein the shelf comprises a top surface of a rigid post.

15. The bracket of claim 13 wherein the flexible arm extends upwardly from the base.

16. The bracket of claim 15 further comprising a rigid post extending upwardly from the base, the shelf comprising a top surface of the rigid post.

17. The bracket of claim 13 further comprising a cammed surface above the latch for moving the flexible arm when the printed circuit board is pushed downwardly onto the cammed surface.

18. The bracket of claim 12 wherein the mounting means comprises a hole in the base through which a screw extends to engage a mounting screwhole on the block of the connector.

19. The bracket of claim 12 wherein the base further comprises an alternative mounting screwhole for engagement by a screw for mounting the connector with the bracket attached thereto.

* * * * *